US005083701A

United States Patent [19]

Passamoni

[11] Patent Number: 5,083,701

[45] Date of Patent: Jan. 28, 1992

[54] FOLDED PAPERBOARD CONTAINER

[75] Inventor: Phillip L. Passamoni, Green Bay, Wis.

[73] Assignee: Green Bay Packaging Inc., Green Bay, Wis.

[21] Appl. No.: 528,708

[22] Filed: May 24, 1990

[51] Int. Cl.[5] ..... B65P 5/64

[52] U.S. Cl. ..... 229/125.08; 229/125.17; 229/193

[58] Field of Search ..... 229/125.04, 125.14, 229/125.17, 125.32, 5.5, 193, 125.35, 106; 222/545, 556, 563; 220/339

[56] References Cited

U.S. PATENT DOCUMENTS

| | | | |
|---|---|---|---|
| 1,932,197 | 10/1933 | Sutherland | 229/193 |
| 2,152,322 | 3/1939 | Moore | 229/125.17 |
| 2,778,557 | 1/1957 | Moore | 229/193 |
| 2,847,151 | 8/1958 | Meyer-Jagenberg | 229/125.14 |
| 3,093,272 | 6/1963 | Esthus | 222/545 |
| 3,223,275 | 12/1965 | Rice, Jr. | 220/339 |
| 3,298,590 | 1/1967 | Gray | 229/125.08 |
| 3,498,521 | 3/1970 | Gill | 229/193 |
| 4,047,660 | 9/1977 | Bell et al. | 229/125.17 |
| 4,495,209 | 1/1985 | Whiteside | 229/125.17 |
| 4,533,063 | 8/1985 | Buchner et al. | 229/125.35 |
| 4,538,731 | 9/1985 | Cillario | 220/339 |
| 4,706,874 | 11/1987 | Reil | 229/106 |

*Primary Examiner*—Gary E. Elkins

*Attorney, Agent, or Firm*—Andrus, Sceales, Starke & Sawall

[57] ABSTRACT

A folded paperboard container formed of a flat sheet of paperboard having a thermoplastic coating on a surface thereof. The sheet includes a bottom panel and a pair of side panels each connected to the bottom panel along a first fold line. End panels are connected along second fold lines to each side edge of the side panel. The sheet is folded along the first and second fold lines and the overlapping end panels are heat sealed to provide an open-ended container. The thermoplastic coating is located on the inner surface of the folded container. A molded plastic dispenser lid is secured by heat sealing within the open end of the container.

3 Claims, 1 Drawing Sheet

FOLDED PAPERBOARD CONTAINER

BACKGROUND OF THE INVENTION

Small, hard, articles such as pharmaceutical products, candy, breath mints, and the like, are normally sold in glass or plastic bottles. The use of plastic or glass bottles has certain disadvantages, primarily in the cost of shipping the empty bottles from the bottle manufacturer to the location where the bottles are to be filled. In addition, bottles require a separate label which is normally attached to the bottle through an adhesive.

Recently, molded, transparent plastic vials or containers have been used to package articles, such as breath mints, candies, and the like. The vial is molded with an open end and a separate molded plastic closure is secured within the open end of the vial. The closure is provided with a dispensing opening which can be opened and closed by a hinged lid. The molded plastic vial provides a weight reduction over glass bottles, but due to the volume, the shipping and storage costs are substantial. Further, separate labels are also required with the molded plastic vials.

SUMMARY OF THE INVENTION

The invention is directed to a folded paper-board container which has particular use for containing small articles such as pharmaceutical products, candy, breath mints, or the like. The container is formed of a flat sheet of paperboard having a surface coated with a layer of thermoplastic material, such as polyethylene. The flat sheet includes a bottom panel and a pair of side panels are connected to opposed edges of the bottom panel along first fold lines.

The sheet also includes a pair of end panels connected along second fold lines to the side edges of each side panel. The sheet is folded along the first and second fold lines to provide an open ended container with the end panels disposed in overlapping relation. The overlapping end panels are then heat sealed to provide the assembled container.

A molded plastic closure is inserted in the open end of the paperboard container, with the side walls of the closure disposed in lapping relation to the side panels of the container and the lapping walls are secured together by heat sealing. The closure contains a dispensing opening through which the product contained in the container can be dispensed and the opening is enclosed by an integral hinged lid.

With the invention, the flat die-cut plastic coated sheets are shipped to the processor where they are folded and assembled to form the open-ended container. The open-ended container is then loaded with the product and the closure is then inserted and heat sealed within the open end of the container. As the containers are shipped as flat sheets, the shipping and storage costs are substantially reduced as compared to the use of plastic or glass bottles and vials.

As a further advantage, the paperboard is less costly than glass or molded plastic bottles.

Moreover, printing can be done directly on the flat unfolded paperboard prior to assembly of the container, thus eliminating the need for separate labels and the label applying equipment.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
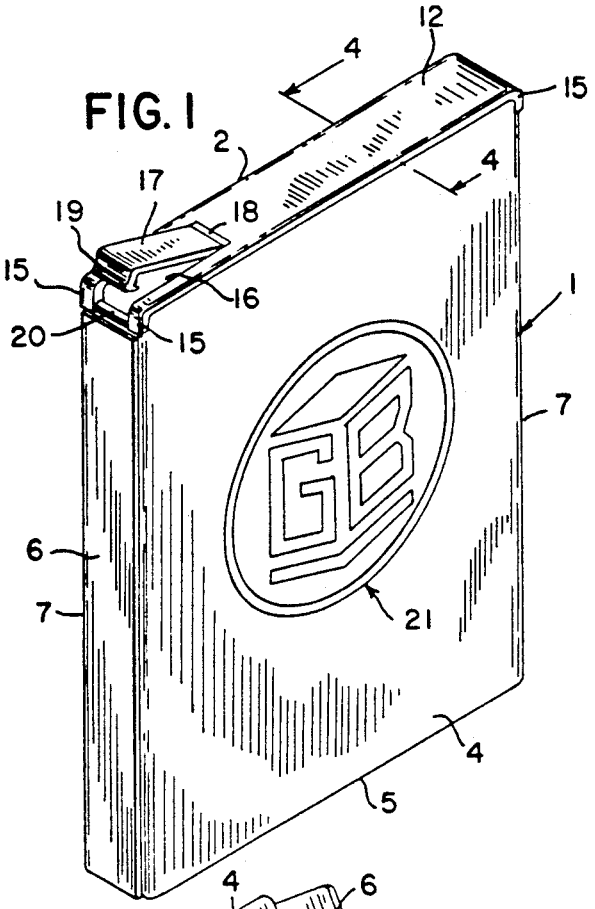
FIG. 1 is a perspective view of the assembled container of the invention.

FIG. 1 illustrates an open-ended paperboard container 1 having a molded plastic closure 2 secured within the open end. The container is adapted to contain small, relatively hard articles, such as pharmaceutical products, breath mints, candy, or the like.

Figure 2:
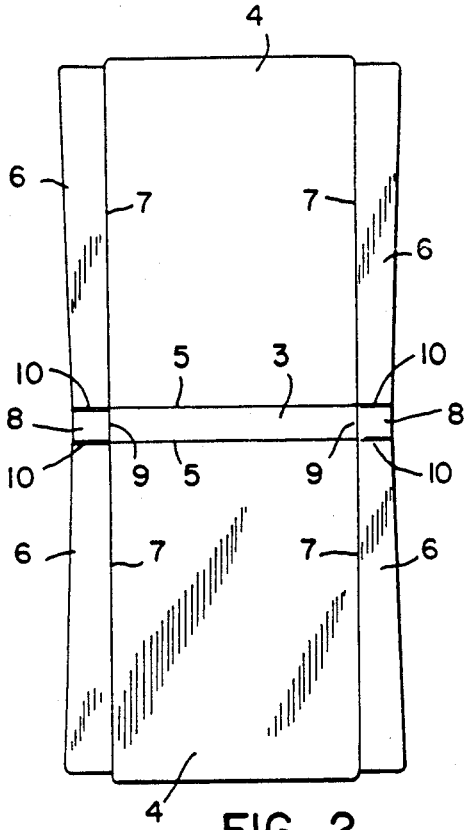
FIG. 2 is a plan view of the flat sheet of paperboard before folding.

FIG. 2 shows the paperboard sheet in flat form before folding. The paperboard sheet includes a bottom panel 3 and a pair of side panels 4 are connected to opposite edges of the bottom panel along fold lines 5. A pair of end panels 6 are connected to opposite edges of each side panel 4, along fold lines 7.

In addition, tabs 8 are connected to opposite ends of bottom panel 3, along fold lines 9, and slits 10 separate the adjacent edges of tabs 8 from end panels 6.

At least one surface of the paperboard sheet is coated with a thermoplastic material, such as polyethylene, and in general, the coating 11 has a thickness in the range of 0.001 to 0.003 inch.

Figure 3:
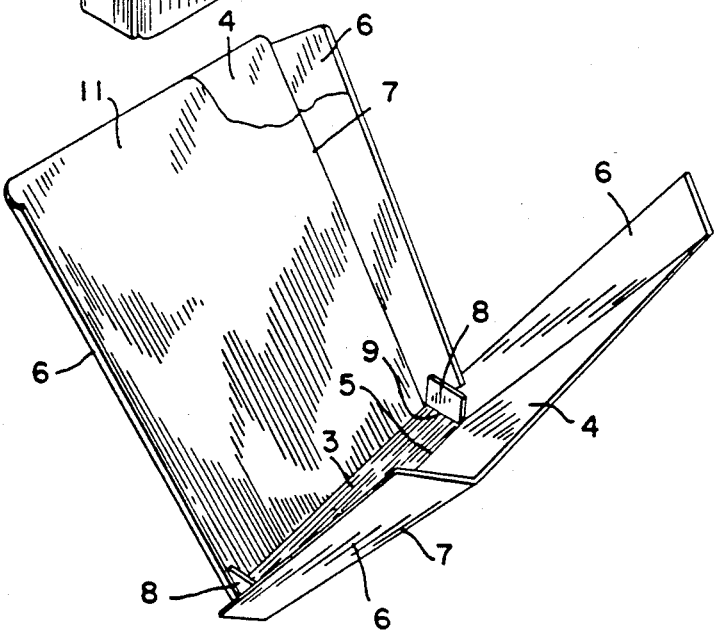
FIG. 3 is a perspective view of the partially folded paperboard.
Figure 4:
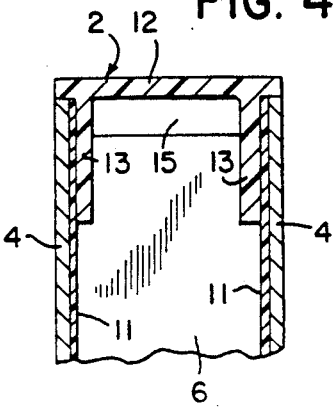
FIG. 4 is a section showing the connection of the closure to the container.

The paperboard sheet is folded along fold lines 5, 7, and 9, as illustrated in FIG. 3, to form the open ended container 1. In the folded container the end panels 6 are disposed in overlapping relation and by heating the overlapping end panels through use of a suitable heat sealing fixture, not shown, the thermoplastic coating 11 on the end panels will be fused to provide a heat sealed joint.

The molded plastic closure 2 includes a top wall 12, a pair of side walls 13 and a pair of end flanges 15. The side panels 4 of container 1 are disposed in overlapping relation with respect to the side walls 13 and the ends of the overlapping end panels 6 are disposed in abutting relation to the end flanges 15 of the closure.

Closure 2 is formed with a dispensing opening 16 and a lid 17 is connected through an integral hinge 18 to top wall 12 and is adapted to enclose the opening 16. The outer or distal end of lid 17 is provided with a latch 19 which engages lip 20 when the lid is in the closed position to hold the lid in a closed condition.

The closure 2 is secured within the open end of the container by a heat sealing operation, in which the overlapping walls 4 and 13 are heated to fuse the thermoplastic coating 11 on the inner surface of the side walls 4 to provide a heat sealed joint. As the walls 13 of closure 2 are considerably thicker than the thermoplastic coating 11, the heat will melt the coating but will not melt the thicker walls 13.

Printing 21 can be applied to the outer surfaces of the side panels 4 and end panels 6. The printing 20 is normally applied to the flat sheet of paperboard before the paperboard is folded to form the container 1. As the printing is done directly on the paperboard, it eliminates the need for separate labels to be applied to the assembled container and similarly eliminates the operation of attaching the labels to the container surfaces.

The thermoplastic coating 11 serves a dual function in that it provides an impervious coating on the inner surface of the container which is contact with the contained product, and also acts as a medium for heat sealing the container in the assembled condition, as well as heat sealing the closure 2 to the container.

With the invention, the unfolded, die cut, flat sheets of paperboard containing the thermoplastic coating are shipped in the flat state to the processor, where by machine operation, the sheets are folded and heat sealed to assemble the containers and the closures 2 are inserted and heat sealed. This provides a substantial reduction in shipping and storage costs as compared to the use of plastic or glass bottles.

Furthermore, the overall cost of the paperboard container is less than glass bottles or molded plastic vials.

Various modes of carrying out the invention are contemplated as being within the scope of the following claims particularly pointing out and distinctly claiming the subject matter which is regarded as the invention.

We claim:

1. A folded paperboard container, comprising a flat sheet of paperboard having a thermoplastic coating on a surface thereof, said sheet comprising a bottom panel, a pair of side panels each connected to opposite edges of said bottom panel along a first fold line and end panels connected along a second fold line to each side edge of each side panel, said sheet being folded along said first and second fold lines to provide an open-ended container with the end panels associated with each side panel being disposed in overlapping relation, and a rigid molded plastic dispenser closure secured within the open end of said container, said closure having a flat top and a pair of side walls disposed flatwise to the respective side panels of the folded container, said thermoplastic coating being disposed between the flatwise side panels and side walls and being fused to provide a heat sealed joint between said flatwise side panels and side walls, said closure also having a pair of side flanges with each side flange projecting outwardly beyond the respective side wall and said closure also having a pair of end walls connecting the corresponding ends of said side walls, said side walls having a greater depth than said end walls, the upper edges of said side panels being disposed in abutting relation with the lower surfaces of the respective side flanges and the upper edges of the end panels disposed in abutting relation with the lower edges of the respective end walls.

2. The container of claim 1, wherein said closure is provided with an opening, said opening being disposed in said top wall and extending into a first of said end walls, said container also including a lid hinged to the top wall and having a first section disposed flush with said top wall and having a second section disposed generally normal to the first section and disposed flush with said first end wall.

3. The container of claim 1 wherein said lid is connected to said closure by an integral hinge.

* * * * *